US006706150B1

(12) United States Patent
Ahonen et al.

(10) Patent No.: US 6,706,150 B1
(45) Date of Patent: Mar. 16, 2004

(54) METHOD AND ARRANGEMENT OF IMPINGEMENT FOR BLOWING COMPENSATION OF A TENDENCY OF CURLING OF A PAPER BOARD WEB TO BE TREATED AS WELL AS A PAPER OR BOARD MACHINE

(75) Inventors: Pasi Ahonen, Jyväskylä (FI); Harri Kiiskinen, Jyväskylä (FI); Oleg Timofeev, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/009,095

(22) PCT Filed: May 9, 2000

(86) PCT No.: PCT/FI00/00410

§ 371 (c)(1),
(2), (4) Date: Mar. 13, 2002

(87) PCT Pub. No.: WO00/68499

PCT Pub. Date: Nov. 16, 2000

(30) Foreign Application Priority Data

May 10, 1999 (FI) ..... 991079

(51) Int. Cl.[7] ..... D21F 11/00

(52) U.S. Cl. ..... 162/207; 162/206; 162/198; 162/359.1; 162/375; 162/261; 162/358.5; 34/114; 34/115; 34/445; 34/451; 34/452; 34/463; 34/549

(58) Field of Search ..... 162/207, 206, 162/198, 359.1, 358.5, 375, 261; 34/114, 115, 116, 445, 446, 451, 452, 463, 549, 565

(56) References Cited

U.S. PATENT DOCUMENTS

| | | | | |
|---|---|---|---|---|
| 3,948,721 A | | 4/1976 | Winheim | |
| 4,202,113 A | | 5/1980 | Kankaanpää | |
| 4,549,932 A | | 10/1985 | Goetz et al. | |
| 4,934,067 A | | 6/1990 | Wedel | |
| 5,269,074 A | | 12/1993 | Sims et al. | |
| 5,416,980 A | | 5/1995 | Ilvespaa | |
| 5,495,678 A | | 3/1996 | Ilmarinen et al. | |
| 5,557,860 A | | 9/1996 | Kotitschke et al. | |
| 5,678,321 A | * | 10/1997 | Deshpande et al. | 34/115 |
| 5,925,407 A | | 7/1999 | Östman | |
| 5,983,523 A | | 11/1999 | Ijäs et al. | |
| 6,001,421 A | | 12/1999 | Ahonen et al. | |
| 6,003,241 A | | 12/1999 | Komulainen et al. | |
| 6,038,789 A | | 3/2000 | Kaihovirta et al. | |

FOREIGN PATENT DOCUMENTS

| | | |
|---|---|---|
| FI | 54627 | 9/1978 |
| FI | 821431 | 10/1989 |

(List continued on next page.)

OTHER PUBLICATIONS

U.S. patent application No. 08/467,780, filed Jun. 6, 1995.

*Primary Examiner*—Steven P. Griffin
*Assistant Examiner*—Mark Halpern
(74) *Attorney, Agent, or Firm*—Stiennon & Stiennon

(57) ABSTRACT

An air impingement arrangement and method for compensating for the curling tendency of a paper or board web which is being treated. Air impingement is disposed in connection with a paper or board process or with its finishing process and extends across the width of the web (10) running in the vicinity thereof, forming a contact-free web treatment zone, in which process the web is dried in at least one dryer unit (3, 5, 7) that applies single-wire draw. In accordance with the invention, air impingement directed at the web (10) is produced by the air impingement arrangement (20) in the web treatment zone, said air impingement including, one following after the other, at least one hot blowing with air and at least one cold blowing with air. The invention also relates to a paper or board machine provided with this kind of air impingement arrangement.

39 Claims, 3 Drawing Sheets

FOREIGN PATENT DOCUMENTS

| | | |
|---|---|---|
| FI | 91900 | 5/1994 |
| FI | 951748 | 4/1995 |
| FI | 964830 | 12/1996 |
| FI | 98387 | 2/1997 |
| FI | 971301 | 3/1997 |
| FI | 971713 | 4/1997 |
| FI | 972080 | 5/1997 |
| FI | 100013 B | 8/1997 |
| FI | 101488 B | 3/1998 |
| WO | WO 88/06204 | 8/1988 |
| WO | WO 88/06205 | 8/1988 |
| WO | WO 97/45588 | 12/1997 |
| WO | WO 99/18287 | 4/1999 |
| WO | WO 00/68499 | 11/2000 |

* cited by examiner

METHOD AND ARRANGEMENT OF IMPINGEMENT FOR BLOWING COMPENSATION OF A TENDENCY OF CURLING OF A PAPER BOARD WEB TO BE TREATED AS WELL AS A PAPER OR BOARD MACHINE

CROSS REFERENCES TO RELATED APPLICATIONS

This application is a national stage application of PCT Application No. PCT/F100/00410, filed May 9, 2000, and claims priority on Finnish Application No. 991079, filed May 10, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to paper and board machine air impingement methods and apparatus for compensating for the curling tendency of a paper or board web.

As known in the prior art, multi-cylinder dryer units of a paper machine employ twin-wire draw and/or single-wire draw. In twin-wire draw, the drying cylinder groups comprise two wires which press the web one from above and the other from below against heated cylinder surfaces. Between the drying cylinder rows, generally horizontal rows, there are free and unsupported draws, in which connection the web is susceptible to fluttering, which may cause web breaks, especially when the web is still moist and therefore weak. For this reason, single wire draw has recently been adopted and applied in the dryer unit in practice without an exception, each drying cylinder group of the single wire draw including only one drying wire, on support of which the web runs through the entire group such that, on the drying cylinders, the drying wire presses the web against heated cylinder surfaces, and on the reversing cylinders or rolls between the drying cylinders, the web runs on the outer surface of the drying wire. Typically, the dryer unit of a paper machine comprises 20–30 drying cylinders and reversing cylinders, in which connection a multi-cylinder dryer has 5–8 wire groups and the groups located at the upstream end of the dryer unit are normally shorter than the groups at the downstream end thereof.

In so-called normal single-wire draw groups of the prior art, the heated drying cylinders are located in an upper row and the reversing cylinders are located in lower rows, which rows are commonly horizontal and parallel to one another. The applicant's FI patent 54627 (corresponding U.S. Pat. No. 4,202,113) proposes placing successively above-mentioned normal single-wire groups and so-called inverted single-wire groups, in which heated drying cylinders are located in a lower row and reversing suction cylinders or rolls are located in an upper row with the main purpose of drying the web symmetrically on both sides thereof. Beloit Corp. have also put forward some proposals for dryer units comprising normal and inverted cylinder groups, in respect of which reference is made to international application publications WO 88/06204 and WO 88/06205 and to U.S. Pat. No. 4,934,067, which proposes inverted groups for a dryer unit for control of curl. According to U.S. Pat. No. 5,269,074 (Beloit Corp.), a long dryer unit applying single-wire draw is followed by a short dryer unit applying twin-wire draw with the purpose of controlling curl of the web.

The use of moist steam for straightening curl has already been known in the art since the 1970's and the 1980's, as appears in U.S. Pat. No. 3,948,721 (Vinheim Karl) or in U.S. Pat. No. 5,557,860 (Voith) and in public FI patent application 821431, which teaches passing the web through a steam treatment station in order to straighten curl. Recently, dryer units provided with single-wire draw have become common in which the upper or lower cylinders are steam-heated drying cylinders, the web coming into direct contact with said cylinders while being pressed by the drying wire, and in which the lower or upper cylinders are cylinders provided with internal suction, for example, Metso Paper, Inc.'s so-called VAC-ROLL™ cylinders in which a vacuum effect is directed through the perforated shell of the cylinders from the interior space of the reversing cylinder to the grooves extending around the shell of the cylinder. Said vacuum effect serves to maintain the web in contact with the drying wire when the web comes to the side of the outside curve on the reversing cylinders. At the same time, the transverse shrinkage of the web is sought to be prevented while drying progresses.

In paper and board machines, the reeling of the web is usually sought to be carried out when the web is as cold as possible, and in order to achieve this aim, it is prior known that a cooling cylinder is used at the end of the dryer unit. In accordance with the commonly known state of the art, the cooling of the web has the following effects:

- the relaxation time of the web can be shortened, which leads to smaller differences of stress in the web before the next process stage (e.g. calendering or reeling) as compared with a situation that the web is passed forwards at a higher temperature,
- the temperature differences themselves can be reduced by lowering temperature level, which leads to smaller differences in the elastic-plastic behaviour of the web in the next process stage or before it.

The most substantial problem associated with single-wire draw is that drying heating is directed, i.e. by convection from the surface of a heated drying cylinder, more intensely only at one surface of the web from one direction. As a result of this one-direction heating, there arises a strong tendency to curl in the web. This problem is also previously known and in order to deal with it, several different solutions have been proposed in the course of years. However, it is common to all these solutions that there remain in the web more or less internal stresses which will release in an unpredictable manner at a later stage and may cause problems as soon as in connection with finishing, such as coating and reeling, or later at the stage at which the paper product is utilized.

With respect to this complex of problems and the prior art associated with the background of the invention, reference is further made to the publications FI 902616 describes a steam box disposed in a dryer unit for relaxation of drying stresses and thus for compensating for curl.

FI 931263 describes air impingement against a large cylinder which has a diameter>2 m and which is placed inside a drying wire loop. Said publication proposes the division of air impingement into sections, in which connection each section uses hot air or superheated steam having a temperature, moisture and/or pressure which is different in each section in order to prevent transverse shrinkage of the web, to control drying of the web and to achieve a desired moisture profile for the web.

FI 950434 proposes passing a web, which has a tendency to curl because of the nonsymmetrical forward-drying of the bottom and top surfaces of the web, to finishing in which the tendencies to curl are compensated for by moistening and/or plastically working the web.

FI 951748 describes a dryer unit which applies single-wire draw for control of curl and in which the last group is inverted to allow drying on both sides.

FI 963734 proposes an arrangement for drying a coated paper web in a drying group of an after-dryer unit applying single-wire draw, the web being treated in said arrangement after that by means of a steam box in order to compensate for the tendency to curl.

FI 964830 proposes an arrangement for compensating for the curling tendency of a paper web by means of an air impingement device which is placed above a drying cylinder and by which hot moist air is blown against the web.

FI 971301 discloses an arrangement for controlling the curl of a paper web by means of a dryer unit. According to said arrangement, the necessary operations are carried out in several stages while the temperature of the web is below 85° C. According to the publication, the curl control treatment is accomplished by means of a steam box or a moistening device.

FI 971713 proposes arranging a large-diameter air impingement drying cylinder in connection with a dryer unit which applies single-wire draw and has drying cylinders placed below and reversing cylinders placed above, which air impingement drying cylinder is placed inside a drying wire loop and on top or in the vicinity of which cylinder, at both sides, heated smaller-diameter cylinders are placed, whereby, when the web is supported by the drying wire over the entire length of the dryer unit, uneven transverse shrinkage of the web can be prevented and avoided.

FI 972080 proposes disposing a steam box and/or a moistening device and/or an infrared dryer after a calender or, if calendering is not employed, in connection with a machine reel or in connection with the finishing process after it in order to compensate for curl of a web.

Despite numerous approaches of the prior art, it has not been possible to eliminate the curl of the web in paper or board machines and, recently, with increasing running speeds, the curling tendency has been also increased by the more and more common demand for downwardly open dryer units applying single-wire draw to be disposed in paper or board machines in order that the paper or board machine might be placed in a smaller, i.e. lower hall space and that, at the same time, the serviceability of the dryer unit might be improved and the contamination problems kept small. Indeed, a substantial problem with the manufacture of paper and board is still that the control of the profile ability of the web is slow, and different elongation streaks, waves or curls arise because of drying stresses, and that paper or board subjected to unequal-sided drying, in particular thin paper grades, such as different directory papers, exhibits very intense wave formation and curl when they come into contact with the moisture of air after the manufacturing process.

SUMMARY OF THE INVENTION

The primary object of the present invention is to improve compensation for the curling tendency of a paper or board web and attempt to minimize drying stresses arising in the web and to bring the curling tendency of the web to the range of reversible, or structural curl behaviour, in which connection the web is as free as possible from stresses and cooled for being wound as cold as possible. One further object of the invention is also to make control of the profile ability of the web quicker and to increase drying capacity in connection with single-wire draws.

Thus, the invention is based on a new and inventive basic idea that, in order to minimize the drying stresses of a web, in at least one zone in which the web is treated with air and which extends substantially across the entire width of the web, air impingement directed at the web includes, one following after the other, at least one hot air blowing and at least one cold air blowing in which the cold air used is hall air from the machinery hall surrounding the paper or board machine, cooled hall air and/or moistened hall air. The moisture of such hall air condenses when the air comes into an environment which is warmer than the air, with the result that the web in cold air impingement is not only cooled but also moistened by the action of the blowing air because condensed moisture is condensed and/or absorbed into the web, in which connection the curl behaviour of the web changes with moisture to the range of structural, i.e. reversible curl behaviour, which is conducive to substantially compensating for the curling tendency of paper or board.

In accordance with the invention, it is advantageous that an air impingement arrangement is arranged in a hood which is located above a drying cylinder, a suction roll or an air-impingement roll, which is advantageously the last drying cylinder, suction roll or air-impingement roll of a dryer unit, and which hood is divided with a partition wall into two sections, in which connection the web is subjected in the machine direction first to a blowing with hot air and after that to a blowing with cold air. In that connection, the air treatment zone of the web comprises a first and a second area which are defined by the bipartite hood at said hood and which extend across the width of the web. In that connection, depending on the drying wire loop arrangement, air impingement can be applied either directly to the free surface of the web or to the free surface of the drying wire located on the web. As an alternative to a bipartite hood, the air impingement arrangement can comprise in accordance with the invention Two successive hoods placed on top of two successive drying cylinders, suction rolls and/or air impingement rolls, in which connection the former hood in the machine direction is advantageously located in connection with the second last drying cylinder, suction roll or air impingement roll and blows hot air against the web and the latter hood in the machine direction is advantageously located in connection with the last drying cylinder, suction roll or air impingement roll and blows cold air against the web. In that connection, the zone for air treatment of the web is bipartite and comprises separately a first area extending across the width of the web and located at the hood blowing hot air and a second area extending across the width of the web and located at the hood blowing cold air;

A hood arranged in connection with a drying cylinder, a suction roll or an air impingement roll, which is advantageously the last drying cylinder, suction roll or air impingement roll of a dryer unit, which hood blows hot air against the web, and a blow box or an airborne drying unit extending across the web and blowing cold air against the web. In that connection, the zone for air treatment of the web is bipartite and comprises separately a first area extending across the width of the web and located at the hood blowing hot air and a second area extending across the width of the web and located at the blow box or the airborne drying unit blowing cold air.

In accordance with the embodiments of the invention regarded as preferable, it is advantageous that the temperature of the cold air blowing is ≦50° C. For the purpose of cooling the web further before its further treatment, a cooling cylinder can be arranged to cool the web after the air treatment zone.

With respect to the benefits of the invention, it may be mentioned that

- balanced drying can be achieved which minimizes the drying stresses arising in paper,
- cooling of the web before calendering equalizes the temperature differences and temperature profiles appearing in it,
- cooling has been found to generally have a favourable effect on the relaxation of the web,
- when drying takes place by air impingement, crystallization of lignin caused by single-wire draw cylinders can be avoided and final drying can be carried out at low temperatures,
- the drying capacity of single-wire draw increases substantially, even by 10–15%,
- control of drying and cooling is quick and therefore the web can be profiled quickly,
- when cooling cold air blowing is coupled with hot air blowing, energy can be saved,
- air impingement according to the invention can be applied both in a forward-dryer section and in an after-dryer section,
- because of the downwardly open structure, the air impingement arrangement according to the invention makes it possible in a paper or board machine that removal of broke and cleaning of the unit can be carried out directly from machine level and from below the hood,
- when single-wire draw is provided simultaneously with the air impingement arrangement according to the invention, blowers and other auxiliary devices can be placed on the lower level which becomes free or, especially in connection with new machines, the basement space can be left unbuilt altogether in the area of cylinder drying,
- when compared with the cooling of the web accomplished by means of cooling cylinders and on the water-jet principle, the air impingement arrangement according to the invention is
  - clean because no drip water problem is encountered in the invention,
  - advantageous because no displacements of cylinders and a reel are needed, and it also
  - requires little space, is economical in terms of energy and easy to operate,
- the air impingement according to the invention is suitable for use both in on- and off-machine dryer sections and calenders, and can also be located in the middle of a dryer section, for example, in on-machine calendering and in intermediate calendering, and
- it can be applied both to coated and to uncoated papers and boards.

With respect to other special features of the invention and to the advantages attainable by them, reference is made to the dependent claims of the accompanying set of claims.

BRIEF DESCRIPTION OF THE DRAWINGS

The invention will be described below with reference to the accompanying drawing in which.

DESCRIPTION OF THE PREFERRED EMBODIMENTS

Figure 1:
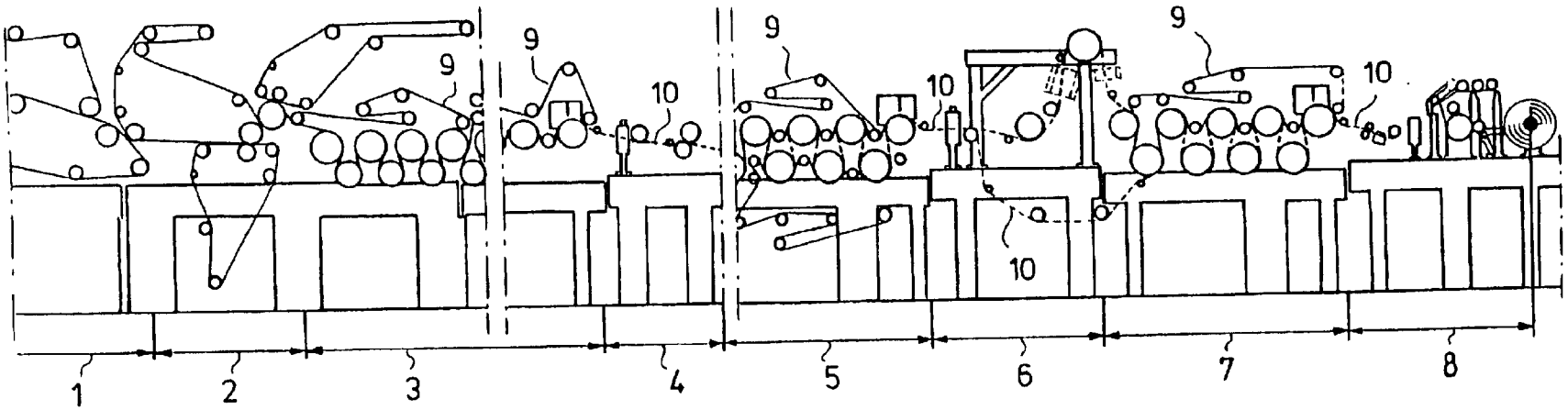
FIG. 1 shows generally a paper or board machine which is provided with an air impingement arrangement in accordance with a first advantageous embodiment of the invention.

FIG. 1 shows an LWC paper machine which includes:

- a unit 1 for forming a paper or board web 10,
- a press unit 2,
- a dryer unit 3 which applies single-wire draw,
- a calendering unit 4,
- a first after-dryer unit 5, i.e. located after calendering, which applies twin-wire draw, and the paper machine shown in FIG. 1 additionally includes as finishing equipment:
  - a coating unit 6 which can be bypassed in the run illustrated in the figure,
  - a second after-dryer unit 7, i.e. located after the coating unit 6, which unit applies twin-wire draw, and
  - a reeling unit 8.

As seen from FIG. 1, the dryer unit 3 and both after-dryer units 5 and 7 are provided with an air impingement arrangement 20 disposed in connection with and on top of the last drying cylinder of each of said units in accordance with the invention. An impingement blowing is directed against the web 10 by means of the air impingement arrangement in order to compensate for any curl of the web. The air impingement arrangement 20 extends substantially across the entire width of the web 10 running in the vicinity of, i.e. by and under said arrangement, forming with the web 10 a zone for contact-free treatment of the web with air, in which zone the cold air used for treatment of the web is most advantageously:

- hall air
- cooled hall air or
- moistened hall air from the machinery hall surrounding the paper or board machine.

In accordance with the invention, the impingement applied to the web 10 from the impingement arrangement 20 is thus constituted by a hot blowing and a cold blowing with air, said blowings following one after the other. In that connection, with the moisture which condenses and/or is absorbed into the web in cold air blowing, the curl behaviour of the web changes to the range of structural, i.e. reversible curl behaviour. In order to assure that moisture is condensed and/or absorbed into the web, it is advantageous that the temperature of the cold air blowing is substantially lower than the temperature of the hot air blowing and/or the temperature of the web 10 running under the air treatment zone. Most commonly, the temperature of the hall air used in cold air blowing is below 30° C., but the air may be heated in blowers by 15–20° C. Despite this heating, the cold air which is blown is substantially colder than the temperature of 90–120° C. of the web and/or the surroundings around it at the downstream end of the dryer unit. Advantageously, the temperature of cold air blowing is below 50° C. When hot and cold air meet each other, the moisture present in the air condenses, being then enabled to pass into the web with the flow of air and to be absorbed into it and/or to condense in it.

FIG. 1 illustrates two advantageous ways to arrange air impingement in accordance with the invention in a drying zone. Thus, as shown in FIG. 1, air impingement can be directed so as to act either on the top surface of a drying wire 9 located on the web 10 placed against a drying cylinder, in which connection the air impingement arrangement 20 is disposed inside a drying wire loop. This kind of embodiment is illustrated in connection with the dryer unit 3 and the second after-dryer unit 7. Alternatively, air impingement can also be arranged to act directly on the free surface of the web 10 which is free on a drying cylinder, in which connection the air impingement arrangement 20 is located outside a drying wire loop, and the drying wire loop is separated from the web before the air impingement arrangement. This kind of embodiment is illustrated in connection with the first after-dryer unit 5.

Figure 5:
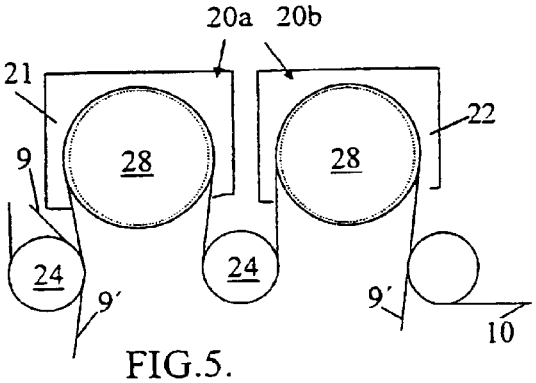
FIG. 5 shows an alternative air impingement arrangement of the second advantageous embodiment of the invention.
Figure 6:
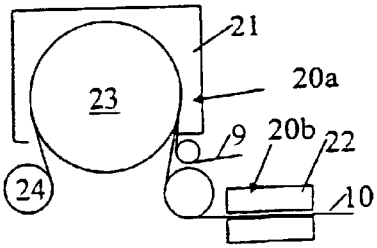
FIG. 6 shows an air impingement arrangement in accordance with a third embodiment of the invention regarded as advantageous.
Figure 7:
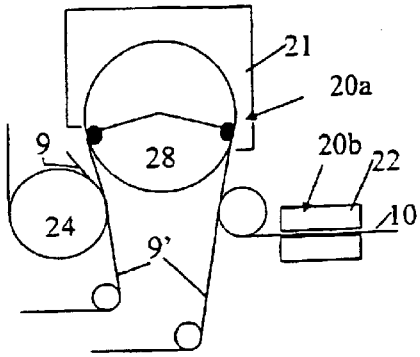
FIG. 7 shows an alternative air impingement arrangement of the third advantageous embodiment of the invention.

In accordance with the embodiments of the invention considered to be advantageous, the air impingement arrangement 20; 20*a*, 20*b*, by means of which the web 10 is first subjected to a hot blowing and then to a cold blowing with air, comprises:

one hood 20 placed on top of a drying cylinder 23, a suction roll or an air impingement roll, the hood being divided by an internal partition wall 27 into a hot air blowing part 21 and a cold air blowing part 22 (cf. FIG. 2 and FIG. 3), two separate hoods 20*a* and 20*b* placed on top of successive drying cylinders 23, suction rolls 28 and/or air impingement rolls, the first of the hoods being a hot air blowing part 21 and the second being a cold air blowing part 22 (cf. FIG. 4 and FIG. 5), or one hood 20*a*, placed on top of a drying cylinder 23, a suction roll 28 or an air impingement roll, the hood functioning as a hot air blowing part 21, and a blow box or an airborne drying unit 20*b* disposed after it and acting on the web, the blow box or the airborne drying unit functioning as a cold air blowing part 22 (cf. FIG. 6 and FIG. 7).

Figure 2:
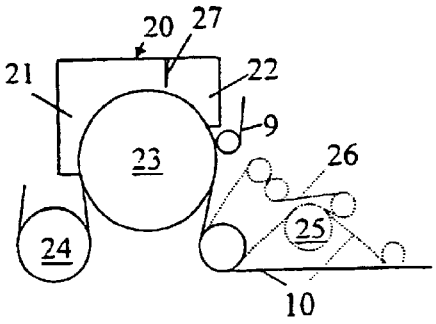
FIG. 2 shows the air impingement arrangement in accordance with the first advantageous embodiment of the invention in more detail.

In the first embodiment of the air impingement arrangement according to the invention shown in FIG. 2, the air impingement arrangement 20 is located inside a drying wire loop and extends across the entire width of the web 10 running under the drying wire 9 in the vicinity thereof, and forms with it a contact-free zone for treatment of the web with air, in which a hot air blowing and a cold air blowing are used for treating the web by impingement, in which the cold air used is advantageously hall air, cooled hall air, or moistened hall air from the machinery hall surrounding the paper or board machine.

Figure 8:
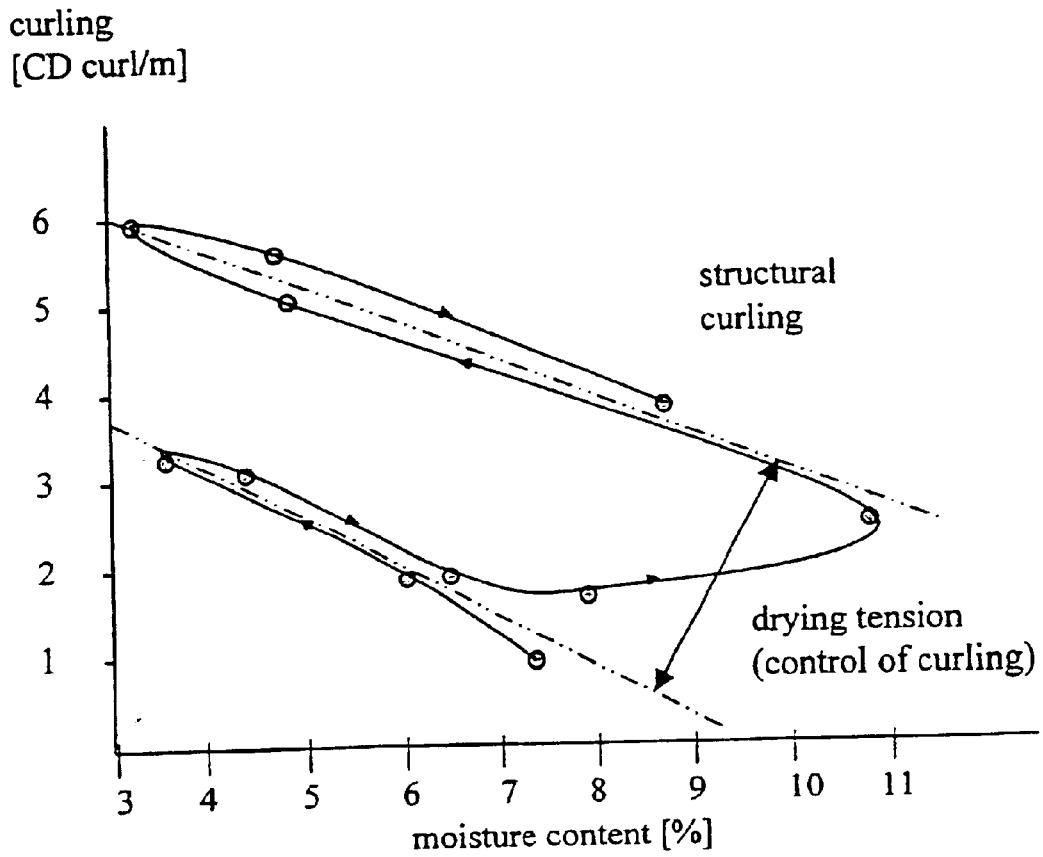
FIG. 8 illustrates the change of curling tendency as a function of moisture content in connection with air impingement in accordance with the invention.

In accordance with the invention, the hot air blowing and the cold air blowing in the air impingement directed at the web 10 in the air treatment zone follow one after the other, in which connection the cold air blowing makes it possible to:

cool the web 10, whereby the temperature differences in the web are equalized, relax stresses arising in drying, and moisten the web 10 by condensing and/or absorbing moisture into it, thus bringing the web 10 to the range of its structural, or reversible, curl behaviour (cf. FIG. 8).

In the first advantageous embodiment of the air impingement arrangement according to the invention as shown in FIG. 2, the air impingement arrangement includes one hood 20, advantageously disposed in connection with the last drying cylinder 23 of the dryer unit 3, 5, 7 on top of the drying cylinder 23.

In order to produce a hot air blowing and a cold air blowing, the hood 20 is divided by the partition wall 27 into two sections, of which the first section in the machine direction is the hot air blowing part 21 and the second section is the cold air blowing part 22. In that connection, in the machine direction, the web 10 is first subjected to a blowing with hot air from the hood 20 and after that to a blowing with cold air. In this kind of air impingement arrangement implemented with one hood, the zone for treatment of the web with air is bipartite and comprises a first and a second area defined by the bipartite hood 20 at it and extending across the width of the web 10.

FIG. 2 illustrates with a broken line one advantageous further application in order to enhance the cooling of the web. In this further application, after the cold blowing part 22 of the air impingement arrangement 20, the web 10 is passed on support of an additional cooling wire 26 against the circumferential surface of an additional cooling cylinder 25. In that connection, it is thus possible to further cool the web 10 in order that it may be calendered as cold as possible. It must be emphasized that this additional feature is not most essential from the point of view of the present invention, but it is described here as a possibility enhancing the cooling effect produced by the cold blowing according to the invention.

In accordance with one embodiment of the invention considered advantageous, the drying cylinder 23, the suction roll 28 or the air impingement roll can also be a cooling cylinder known in itself in the state of the art, whereby a cooling effect can be directed at the web 10 from both sides thereof.

Figure 3:
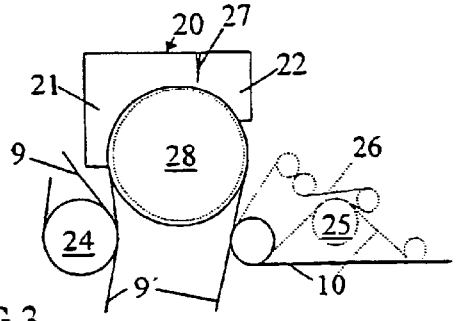
FIG. 3 shows an alternative air impingement arrangement of the first advantageous embodiment of the invention.

The alternative embodiment of the first advantageous embodiment of the invention shown in FIG. 3 differs from the first advantageous embodiment of the invention shown in FIG. 2 in that in the place of the drying cylinder 23, there is a suction roll 28 or an air impingement roll, the roll 28 may be either a suction roll marketed by the applicant under the trademark VAC-roll™, in which roll vacuum is effective on the entire inner surface of the roll (cf. FIG. 3 and FIG. 5), or a conventional suction roll provided with a suction zone (cf. FIG. 7), and at the air impingement arrangement, as a drying wire there is a drying wire 9' located underneath the web 10.

In that connection, the drying wire 9 meandering with the web 10 in the dryer unit 3, 5, 7 has been arranged to separate from the web 10 before the air impingement arrangement, and in the air impingement arrangement both hot air blowing and cold air blowing take place from above directly and immediately against the free top surface of the web 10. In this way, cooling, relaxation of stresses and equalization of temperature differences are even more effective than in the embodiment shown in FIG. 2, in which hot air and cold air blowings take place through or by means of the drying wire 9 against the web 10.

Figure 4:
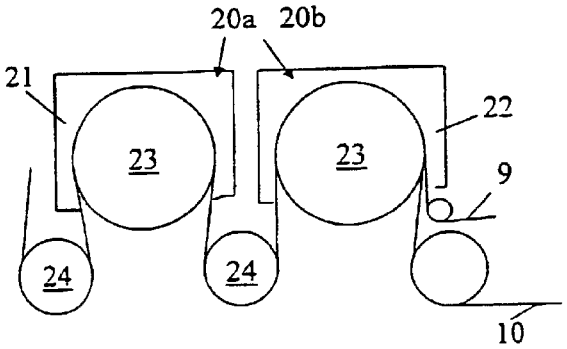
FIG. 4 shows an air impingement arrangement in accordance with a second embodiment of the invention regarded as advantageous.

In the second embodiment of the air impingement arrangement according to the invention shown in FIG. 4, the bipartite air impingement arrangement 20*a*, 20*b* is located inside a drying wire loop and extends across the entire width of the web 10 running under the drying wire 9 in the vicinity thereof, and forms with it a contact-free zone for treatment of the web with air, in which a hot air blowing and a cold air blowing are used for treating the web by impingement, in which connection the cold air is advantageously hall air, cooled hall air, or moistened hall air from the machinery hall surrounding the paper or board machine.

In accordance with the invention, the hot air blowing and the cold air blowing in the air impingement directed at the web 10 in the air treatment zone follow separately one after the other, in which connection the cold air blowing makes it possible to:

cool the web 10, whereby the temperature differences in the web are equalized, relax stresses arising in drying, and moisten the web 10 by condensing and/or absorbing moisture into it, thus bringing the web 10 to the range of its structural, or reversible, curl behaviour (cf. FIG. 8).

In the second advantageous embodiment of the air impingement arrangement 20*a*, 20*b* according to the invention shown in FIG. 4, the air impingement arrangement includes two hoods, advantageously disposed in connection with the last two drying cylinders 23 of the dryer unit 3, 5, 7 on top of the drying cylinders 23. In order to produce a hot air blowing and a cold air blowing, the first hood 20*a* in the machine direction constitutes a hot blowing part 21 and the second hood 20*b* constitutes a cold blowing part 22 of the air impingement arrangement. In other words, in that connection, in the machine direction, the web 10 is subjected to a blowing with hot air from the first hood 20*a* and after that to a blowing with cold air from the second hood 20*b*. In this kind of air impingement arrangement accomplished by means of two separate hoods 20*a*, 20*b*, the web treatment zone is bipartite and comprises separate first and second areas defined by the hoods 20*a* and 20*b* at said hoods and extending across the width of the web 10.

In accordance with one embodiment of the invention regarded as advantageous, the drying cylinder 23, the suction roll 28 or the air impingement roll may also be a cooling cylinder known in itself in the state of the art, in which connection a cooling effect can be applied to the web 10 from both sides thereof.

The alternative embodiment of the second advantageous embodiment of the invention shown in FIG. 5 differs from the second alternative advantageous embodiment of the invention shown in FIG. 4 in that in the place of the drying cylinders 23, there are suction rolls 28 and/or air impingement rolls, and at the air impingement arrangement, as a drying wire there is a drying wire 9' located underneath the web 10.

In that connection, the drying wire 9 meandering with the web 10 in the dryer unit 3, 5, 7 has been arranged to separate from the web 10 before the air impingement arrangement, and in the air impingement arrangement both hot air blowing and cold air blowing take place from above directly and immediately against the free top surface of the web 10. In this way, cooling, relaxation of stresses and equalization of temperature differences are even more effective than in the embodiment shown in FIG. 2, in which hot air and cold air blowings take place through or by means of the drying wire 9 against the web 10.

In the third embodiment of the air impingement arrangement according to the invention shown in FIG. 6, the bipartite air impingement arrangement 20*a*, 20*b* is located inside a drying wire loop and extends across the entire width of the web 10 running under the drying wire 9 in the vicinity thereof, and forms with it a contact-free zone for treatment of the web with air, in which a hot air blowing and a cold air blowing are used for treating the web by impingement, in which connection the cold air is advantageously hall air, cooled hall air, or moistened hall air from the machinery hall surrounding the paper or board machine.

In accordance with the invention, the hot air blowing and the cold air blowing in the air impingement directed at the web 10 in the air treatment zone follow separately one after the other, in which connection the cold air blowing makes it possible to:

cool the web 10, whereby the temperature differences in the web are equalized, relax stresses arising in drying, and moisten the web 10 by condensing and/or absorbing moisture into it, thus bringing the web 10 to the range of its structural, or reversible, curl behaviour (cf. FIG. 8).

The air impingement arrangement 20*a*, 20*b* according to the third advantageous embodiment of the invention shown in FIG. 6 includes a hood 20*b*, advantageously placed in connection with the last two drying cylinders 23 of the dryer unit 3, 5, 7 on top of the dryer cylinders 23, and a blow box or an airborne drying unit 20*b* extending across the web 10 and blowing cold air against the web.

In order to provide a hot air blowing and a cold air blowing in the machine direction, the hood 20*a* constitutes the hot air blowing part 21 of the air impingement arrangement and the blow box or the airborne drying unit 20*b* constitutes the cold air blowing part 22 of the air impingement arrangement. In other words, in that connection, in the machine direction, the web 10 is subjected to a blowing with hot air from the hood 20*a* and after that to a blowing with cold air from the second blow box or the airborne drying unit 20*b*. In this kind of air impingement arrangement accomplished by means of a hood 20*a* and a blow box or an airborne drying unit 20*b* which are separate from each other, the web treatment zone is bipartite and comprises separate first and second areas which extend across the width of the web 10 and are defined by the hood 20*a* and the blow box or the airborne drying unit 20*b* at the hood and at the blow box or the airborne drying unit.

In accordance with one embodiment of the invention regarded as advantageous, the drying cylinder 23, the suction roll 28 or the air impingement roll may also be a cooling cylinder known in itself in the state of the art, in which connection a cooling effect can be applied to the web 10 from both sides thereof.

The alternative embodiment of the third advantageous embodiment of the invention shown in FIG. 7 differs from the third advantageous embodiment of the invention shown in FIG. 6 in that in the place of the drying cylinders 23, there is a suction roll 28 or an air impingement roll, and at the air impingement arrangement, as a drying wire there is a drying wire 9' located underneath the web 10.

In that connection, the drying wire 9 meandering with the web 10 in the dryer unit 3, 5, 7 has been arranged to separate from the web 10 before the air impingement arrangement, and in the air impingement arrangement both hot air blowing and cold air blowing take place from above directly and immediately against the free top surface of the web 10. In this way, cooling, relaxation of stresses and equalization of temperature differences are even more effective than in the embodiment shown in FIG. 2, in which hot air and cold air blowings take place through or by means of the drying wire 9 against the web 10.

FIG. 8 illustrates the effect of the drying operations applied to paper on the curl of paper. The behaviour of paper has been changed by means of drying stresses with respect to its structural curl. In the figure, the structural curl of paper is shown by the upper line of dots and dashes and its range is reached:

by drying the paper from an initial state in which the curl=1 CD curl/m and the moisture content=7.2% to a predried state in which the curl=3.3 CD curl/m and the moisture content=3.5%, and then allowing the paper to be moistened from the predried state to the initial state of structural curl behaviour in which the curl=2.5 CD curl/m and the moisture content=7.2%.

After that, in spite of drying or rewetting of the paper, the curl of the paper is predictable and remains in the range of reversible structural curl behaviour.

This relaxation of drying stresses according to the invention make it possible to assure that the stresses are in balance such that at final moisture the paper is already at the curve of structural curl and moisture shown in FIG. 8, and unpredictable curl of the paper does not cause any problems in the finishing or subsequent utilization of the paper.

Above, the invention has been described only by means of some of its embodiments regarded as advantageous and by means of some of their alternative embodiments. This is naturally not intended to limit the invention so as to relate only to this kind of single embodiments. Thus, as is clear to a person skilled in the art, many variations and alternative solutions are feasible within the inventive idea and within the scope of protection defined in the accompanying claims.

What is claimed is:

1. An air impingement apparatus for compensating for the curling tendency of a paper or board web which is being treated, on a paper or board making or related finishing process machine, said machine having at least one dryer unit which comprises at least one downwardly open single-wire draw group, and being configured to perform in or after the dryer unit, or both in and after the dryer unit, an operation selected from the group consisting of reeling, calendering, intermediate calendering, coating, and additional drying on the web; the apparatus comprising:

at least one air impingement hood positionable to extend substantially across the entire width of the web to define a contact-free web treatment zone; and wherein the at least one air impingement hood is connected to a source of hot air and a source of cold air, the at least one air impingement hood being configured to produce in the web treatment zone in a direction directed at the web, one following after the other, at least one hot blowing with air from the source of hot air onto the web and at least one cold blowing with air from the source of cold air onto the web.

2. The air impingement apparatus of claim 1, wherein moisture condenses and/or is absorbed into the web in cold air blowing, such that the curl behaviour of the web changes to the range of structural, reversible, curl behaviour.

3. The air impingement apparatus of claim 1, wherein the air impingement in the web treatment zone of the web is applied to a free surface of the web.

4. The air impingement apparatus of claim 1, wherein the air impingement in the web treatment zone takes place through a drying wire located on the web.

5. The air impingement apparatus of claim 1 wherein the air impingement arrangement includes at least one hood placed on top of a drying cylinder, a suction roll, an air impingement roll or a cooling cylinder.

6. The air impingement apparatus of claim 5, wherein the air impingement arrangement is in connection with the last drying cylinder, suction roll, air impingement roll or cooling cylinder of the dryer unit, and that the air impingement arrangement comprises a bipartite hood which is divided by a partition wall into two sections, in which connection, in a machine direction, the web is first subjected to a blowing with hot air from a hot blowing part of the bipartite hood and after that to a blowing with cold air from a cold blowing part of the bipartite hood.

7. The air impingement apparatus of claim 6, wherein the air treatment zone of the web comprises a first and a second area which are defined by the bipartite hood at said hood and which extend across the width of the web.

8. The air impingement apparatus of claim 5, wherein the at least one air impingement hood comprises two successive and separate hoods placed on top of two successive drying cylinders, suction rolls, air impingement rolls or cooling cylinders, the first of the hoods being a hot blowing part blowing hot air and the latter of the hoods being a cold blowing part blowing cold air.

9. The air impingement apparatus of claim 8, wherein the web treatment zone is beparite and comprises separately a first area which extends across the width of the web and is located at the hot blowing part placed first in a machine direction, and a second area which extends across the width of the web and is located at the cold blowing part placed after that in a machine direction.

10. The air impingement apparatus of claim 8, wherein the hood located first in a machine direction is in connection with a second last drying cylinder, suction roll, air impingement roll or cooling cylinder, and that the hood located after that in a machine direction is in connection with a last drying cylinder, suction roll, air impingement roll or cooling cylinder.

11. The air impingement apparatus of claim 5, wherein the hood has a hot blowing part blowing hot air against the web, and a blow box or an airborne drying unit which extends across the web and which is a cold blowing part blowing cold air against the web.

12. The air impingement apparatus of claim 11, wherein the web treatment zone bipartite and comprises separately a first area which extends across the width of the web and is located at the hood blowing hot air, and a second area which extends across the width of the web and is located at a blow box or an airborne drying unit blowing cold air.

13. The air impingement apparatus of claim 11, wherein the at least one hood is in connection with a last drying cylinder, suction roll, air impingement roll or cooling cylinder of the dryer unit.

14. The air impingement apparatus of claim 1, wherein in order to cool the web further before it is processed further, a cooling cylinder is additionally arranged to cool the web treatment zone or after it.

15. The air impingement apparatus of claim 1, wherein the temperature of air of the cold blowing is below 50° C.

16. A method for air impingement in order to compensate for the curling tendency of a paper or board web treated in connection with a paper or board process or with a related finishing process, comprising the steps of:

drying the web in at least one dryer unit having one or more downwardly open single-wire draw groups;

in the dryer unit, or after the dryer unit, or in and after the dryer unit, subjecting the web to at least one operation selected from the group consisting of reeling, calendering, intermediate calendering, coating, and additional drying; and subjecting the web to impingement blowing with air in a contact-free web treatment zone which covers substantially the entire width of the web, wherein in said zone the web is first subjected to at least one hot air blowing and after that to at least one cold air blowing.

17. The air impingement method of claim 16, wherein moisture is condensed and/or absorbed into the web by said cold air blowing, whereby the curl behaviour of the web is changed to the range of structural, reversible, curl behaviour.

18. The air impingement method of claim 16, wherein the step of subjecting the web to air impingement in the web treatment zone comprises the step of directing air directly at a free surface of the web.

19. The air impingement method of claim 16, wherein the step of subjecting the web to air impingement further comprises directing cold air blowing is at the web from above the web through a drying wire.

20. The air impingement method of claim 16, wherein the step of subjecting the web to air impingement comprises blowing air through at least one hood placed on top of a drying cylinder, a suction roll, an air impingement roll or a cooling cylinder and by means of which, in a machine direction, a blowing with hot air is first blown against the web from a hot blowing part and after that a blowing with cold air from a cold blowing part, said drying cylinder, suction roll, air impingement roll or cooling cylinder being disposed in connection with a last drying cylinder, suction roll, air impingement roll or cooling cylinder of the dryer unit and divided into two sections by a partition wall.

21. The air impingement method of claim 16, wherein two separate hoods are used for air impingement, said hoods being placed on top of two successive drying cylinders, suction rolls, air impingement rolls or cooling cylinders disposed as the last cylinders/rolls in the dryer unit, hot air being blown through the hood which is placed first in a machine direction and which is a hot blowing part blowing hot air and located in connection with the second last drying cylinder, suction roll, air impingement roll or cooling cylinder, and cold air being blown through the hood which is placed further down in a machine direction and which is a cold blowing part blowing cold air and located in connection with the last drying cylinder, suction roll, air impingement roll or cooling cylinder.

22. The air impingement method of claim 16, wherein for air impingement are used a hood arranged on top of and in connection with the last drying cylinder, suction roll, air impingement roll or cooling cylinder of the dryer unit, said hood being a hot blowing part blowing hot air against the web, and a blow box or an airborne drying unit which extends across the width of the web and which is a cold blowing part blowing cold air against the web.

23. The air impingement method of claim 16, wherein the web is further cooled during air impingement or after it by a cooling cylinder.

24. The air impingement method of claim 16, wherein the step of subjecting the web to at least one cold air blowing comprises subjecting the web to a blowing in which the temperature of air is below 50° C.

25. A paper or board making machine comprising:

a former unit for a paper or board web;

a press unit;

a source of hot blowing air;

a source of cold blowing air; and at least one dryer unit having a web running therethrough, and having at least one air impingement device first section which extends substantially across the entire width of the web in the vicinity of the web, wherein a first contact-free web treatment zone is defined where the web is subject to the air blowing from the air impingement device first section, and the at least one dryer unit further having at least one air impingement device second section positioned after the first section in the machine direction, the second section extending substantially across the entire width of the web running in the vicinity of the air impingement device second section, a second contact-free web treatment zone being defined where the web is subject to the air blowing from the air impingement device second section, wherein the at least one air impingement device first section is connected to the source of hot blowing air, and the at least one air impingement device second section is connected to the source of cold blowing air, and for the purpose of compensating for the curl of the web, the paper or board making machine being thus configured to apply to the web following one after the other, at least one hot blowing and at least one cold blowing with air.

26. The paper or board making machine of claim 25, wherein moisture condenses and/or is absorbed into the web in cold blowing, and the curl behaviour of the web changes to the range of structural, reversible, curl behaviour.

27. The paper or board making machine of claim 25 wherein the air impingement in the air treatment zones of the web is applied to a free surface of the web.

28. The paper or board making machine of claim 25, wherein the air impingement in the air treatment zones of the web is applied to the web through a drying wire located on the web.

29. The paper or board making machine of claim 25, wherein each air impingement device includes at least one hood which is placed on top of a last drying cylinder, suction roll, air impingement roll or cooling cylinder of the dryer unit and divided by a partition wall, in which connection, in a machine direction, and the first section is divided from the second section by the partition wall.

30. The paper or board making machine of claim 25, wherein the air impingement device comprises two successive and separate hoods, the at least one air impingement device first section being defined by a first hood, and the at least one air impingement device second section being defined by a second hood.

31. The paper or board making machine of claim 25, wherein the first section comprises a hood which is placed first in a machine direction on top of a last drying cylinder, suction roll, air impingement roll or cooling cylinder of the dryer unit and which serves as a hot blowing part and blows hot air against the web; and wherein the second section comprises a blow box or an airborne drying unit which extends across the entire width of the web and which serves as a cold blowing part and blows cold air against the web.

32. The paper or board making machine of claim 25 further comprising a cooling cylinder which acts on the web in a machine direction during or after air impingement.

33. The paper or board making machine of claim 25, wherein the temperature of air of the cold blowing is below 50° C.

34. A paper making machine having an air impingement arrangement for compensating for the curling tendency of a paper or board web which is being treated, the paper making machine comprising:

a dryer unit having a first end roll, and a second end roll positioned upstream of the end roll;

a web passing from the second end roll to the first end roll;

a source of hot blowing air;

a source of cold blowing air;

a first hood portion which extends substantially across the entire width of the web running in the vicinity thereof and forms a contact-free first web treatment zone where the web passes over one of the end rolls, the first hood portion being connected to the source of hot blowing air for discharging hot air onto the first web treatment zone; and a second hood portion which extends substantially across the entire width of the web running in the vicinity thereof and forms a contact-free second web treatment zone where the web passes over one of the end rolls downstream of the first web treatment zone, the second hood portion being connected to the source of cold blowing air for discharging cold air at a lower temperature than the hot air onto the second web treatment zone.

35. The paper making machine of claim 34 wherein the first web treatment zone and the second web treatment zone are both formed over portions of the first end roll, and the first hood portion and the second hood portion are part of a single bipartite hood which is divided by a partition wall.

36. The paper making machine of claim 34 wherein the first web treatment zone is formed over portions of the second end roll, and the second web treatment zone is formed over portions of the first end roll.

37. The paper making machine of claim 34 wherein a drying wire is disposed over the web as it passes through the first web treatment zone and the second web treatment zone.

38. The paper making machine of claim 34 further comprising a cooling cylinder downstream of the first end roll, over which the web travels after passing through the second web treatment zone.

39. The paper making machine of claim 34, wherein the temperature of air at the second web treatment zone is below 50° C.

* * * * *